US011724916B2

(12) United States Patent
Mao et al.

(10) Patent No.: US 11,724,916 B2
(45) Date of Patent: Aug. 15, 2023

(54) INTERLOCK ASSEMBLY FOR ELEVATOR DOOR AND ELEVATOR SYSTEM

(71) Applicant: Otis Elevator Company, Farmington, CT (US)

(72) Inventors: Meihong Mao, Shanghai (CN); Honglei Qu, Shanghai (CN); Fei Long, Shanghai (CN); Yaxin Zhang, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 17/825,727

(22) Filed: May 26, 2022

(65) Prior Publication Data

US 2023/0033794 A1 Feb. 2, 2023

(30) Foreign Application Priority Data

Jul. 27, 2021 (CN) ..... 202110850501.9

(51) Int. Cl.
*B66B 13/12* (2006.01)

(52) U.S. Cl.
CPC ..... *B66B 13/12* (2013.01)

(58) Field of Classification Search
CPC ..... B66B 13/16; B66B 13/12; B66B 13/22; B66B 13/20
See application file for complete search history.

(56) References Cited

U.S. PATENT DOCUMENTS

| | | | | |
|---|---|---|---|---|
| 3,268,679 | A | 8/1966 | Tucker, Jr. | |
| 5,718,055 | A | 2/1998 | Pierce et al. | |
| 5,899,302 | A | 5/1999 | O'Donnell | |
| 6,474,448 | B1 * | 11/2002 | Zappa | B66B 13/20 187/310 |
| 7,350,625 | B2 | 4/2008 | Deplazes et al. | |
| 7,398,862 | B2 * | 7/2008 | Dziwak | B66B 13/20 187/331 |
| 10,189,680 | B2 * | 1/2019 | Yang | B66B 13/20 |
| 11,034,548 | B2 * | 6/2021 | Tracey | B66B 13/20 |
| 2019/0337768 | A1 * | 11/2019 | Kulak | B66B 13/12 |

FOREIGN PATENT DOCUMENTS

| | | | |
|---|---|---|---|
| CN | 101128387 | A | 2/2008 |
| CN | 201325811 | Y | 10/2009 |
| CN | 101124144 | B | 7/2012 |

(Continued)

OTHER PUBLICATIONS

European Search Report for Application No. 22187275.7; dated Jan. 19, 2023; 7 Pages.

*Primary Examiner* — Diem M Tran
(74) *Attorney, Agent, or Firm* — Cantor Colburn LLP

(57) ABSTRACT

An elevator door interlock assembly and an elevator system. The elevator door interlock assembly includes: a first base plate on which a common rotating shaft is arranged; a first hanging wheel, which is pivotally connected to the first base plate through the common rotating shaft and guides the first base plate to reciprocate in an opening and closing direction of an elevator door; and a first lock arm, a middle part of which is pivotally connected to the first base plate through the common rotating shaft, so as to rotate between a locked position and a released position when the elevator door is closed.

12 Claims, 5 Drawing Sheets

(56) References Cited

FOREIGN PATENT DOCUMENTS

| | | | | |
|---|---|---|---|---|
| CN | 103079983 | A | | 5/2013 |
| CN | 102530689 | B | | 9/2015 |
| CN | 204980785 | U | | 1/2016 |
| CN | 106395582 | A | * | 2/2017 |
| CN | 206447455 | U | | 8/2017 |
| CN | 107298369 | A | | 10/2017 |
| CN | 105584923 | B | | 12/2017 |
| CN | 207226777 | U | | 4/2018 |
| CN | 105307964 | B | | 9/2018 |
| CN | 108861920 | A | | 11/2018 |
| CN | 109436998 | A | | 3/2019 |
| CN | 110422737 | A | | 11/2019 |
| CN | 110422739 | A | | 11/2019 |
| CN | 110422740 | A | | 11/2019 |
| CN | 110422741 | A | | 11/2019 |
| CN | 209583359 | U | | 11/2019 |
| CN | 210366556 | U | | 4/2020 |
| EP | 1440930 | B1 | | 4/2016 |
| EP | 3558855 | B1 | | 3/2021 |

* cited by examiner

INTERLOCK ASSEMBLY FOR ELEVATOR DOOR AND ELEVATOR SYSTEM

FOREIGN PRIORITY

This application claims priority to Chinese Patent Application No. 202110850501.9, filed Jul. 27, 2021, and all the benefits accruing therefrom under 35 U.S.C. § 119, the contents of which in its entirety are herein incorporated by reference.

FIELD OF THE INVENTION

The present application relates to the field of elevators, and more specifically, the present application relates to an elevator door interlock assembly for an elevator system.

BACKGROUND OF THE INVENTION

As a tool for improving the walking of passengers between floors or shortening a walking distance of passengers, passenger transportation devices are very common in daily life. As an example, the most common passenger transportation devices are escalators and elevators that are usually used between floors of commercial buildings, and moving walkways that are usually used in large airports.

For an elevator system, it has an elevator car that usually runs in a dedicated hoistway. When the elevator car moves to a target floor, by opening associated landing door and car door, passengers can enter or leave the elevator car; and after that, by closing the associated landing door and car door, passengers are prevented from entering the hoistway by mistake. In this process, an elevator door interlock assembly and a contact switch installed on it are usually used to control the locking and releasing of the closed state of the associated landing door and car door. However, it is extremely challenging to rationally arrange all the parts that complete the aforementioned functions in an extremely limited space between the landing door and the car door. Therefore, it is desired to optimize the structural design of them on the premise of meeting their functional requirements.

SUMMARY OF THE INVENTION

The present application aims to provide an elevator door interlock assembly and an elevator system to solve or at least alleviate some of the above technical problems.

In order to achieve at least one object of the present application, according to an aspect of the present application, an elevator door interlock assembly is provided, which includes: a first base plate on which a common rotating shaft is arranged; a first hanging wheel, which is pivotally connected to the first base plate through the common rotating shaft and guides the first base plate to reciprocate in an opening and closing direction of an elevator door; and a first lock arm, a middle part of which is pivotally connected to the first base plate through the common rotating shaft, so as to rotate between a locked position and a released position when the elevator door is closed.

In addition to or as an alternative to one or more of the above features, in another embodiment, the elevator door interlock assembly further includes: a second base plate on which a hanging wheel shaft is arranged; a second hanging wheel, which is pivotally connected to the second base plate through the hanging wheel shaft, and guides the second base plate to reciprocate in the opening and closing direction of the elevator door; and a second lock arm, which is fixedly connected to the base plate and which is provided with a locking opening thereon; in which a lock hook is also provided at a first end of the first lock arm; when the elevator door is closed, the first lock arm rotates until the lock hook and the locking opening are meshed, and a meshing position of the lock hook and the locking opening is collinear with a rotation center of the common rotating shaft.

In addition to or as an alternative to one or more of the above features, in another embodiment, the elevator door interlock assembly further includes: a first switch plug, which is provided on the first lock arm; and a first switch socket; in which when the elevator door is closed, the first lock arm rotates until the first switch plug is engaged with the first switch socket; an engagement position of the first switch plug and the first switch socket, and the meshing position of the lock hook and the locking opening are collinear with the rotation center of the common rotating shaft.

In addition to or as an alternative to one or more of the above features, in another embodiment, the elevator door interlock assembly further includes: a second switch plug, which is provided on the second lock arm; and a second switch socket; in which when the elevator door is closed, the first base plate moves in the opening and closing direction of the elevator door until the second switch plug on the second lock arm is engaged with the second switch socket.

In addition to or as an alternative to one or more of the above features, in another embodiment, the elevator door interlock assembly further includes: an adjustable connecting plate, which has an installation position fixed to a second end of the first lock arm, the installation position being adjustable in a length direction of the first lock arm; a first door roller, which passes through a middle part of the adjustable connecting plate via a first rotating shaft and is pivotally connected to the first base plate; and a second door roller, which is pivotally connected to a lower part of the adjustable connecting plate via a second rotating shaft.

In addition to or as an alternative to one or more of the above features, in another embodiment, one of an end of the adjustable connecting plate and/or the second end of the first lock arm has fixing holes, and the other of the end of the adjustable connecting plate and/or the second end of the first lock arm has first strip holes arranged in a length direction; in which the adjustment of the installation position of the adjustable connecting plate is realized through the cooperation of the fixing holes and the first strip holes.

In addition to or as an alternative to one or more of the above features, in another embodiment, the middle part of the adjustable connecting plate has a second strip hole arranged perpendicular to the first strip holes, and the second end of the first lock arm has an adjustment hole; in which the adjustment of the installation position of the adjustable connecting plate is also realized through the cooperation of the adjustment hole and the second strip hole.

In addition to or as an alternative to one or more of the above features, in another embodiment, the first rotating shaft passes through the second strip hole of the adjustable connecting plate, and an installation position of the first door roller can be adjusted along a length direction of the second strip hole.

In addition to or as an alternative to one or more of the above features, in another embodiment, the elevator door interlock assembly further includes a second rotating shaft arranged at a fixed position at the lower part of the adjustable connecting plate, and the second door roller is pivotally connected to the lower part of the adjustable connecting plate via the second rotating shaft.

In addition to or as an alternative to one or more of the above features, in another embodiment, the first hanging wheel is arranged between the first base plate and the first lock arm.

In addition to or as an alternative to one or more of the above features, in another embodiment, the elevator door interlock assembly further includes a counterweight, which is arranged at a second end of the first lock arm; in which, the counterweight presses the lock hook to abut against the locking opening relative to the rotating shaft.

In order to achieve at least one object of the present application, according to another aspect of the present application, an elevator system is further provided, which includes: an elevator car having a car door; a landing door moving in association with the car door; and the elevator door interlock assembly as described above; in which when the landing door and the car door moving in association are closed, the first lock arm rotates between the locked position and the released position to maintain the closed state of the landing door and the car door, or release the closed state of the landing door and the car door.

In addition to or as an alternative to one or more of the above features, in another embodiment, when the elevator door interlock assembly includes a first switch plug and a first switch socket, the first switch socket is arranged on the landing door and is engaged with the first switch plug in a way of facing downward.

According to the elevator door interlock assembly and the elevator system of the present application, by providing the first hanging wheel and the first lock arm with a common rotating shaft for pivotal connection, a coaxial design of the first hanging wheel and the first lock arm is realized without affecting their respective functions. On one hand, an installation bracket dedicated to the first hanging wheel is saved and the cost is reduced; on the other hand, the space which is already extremely compact in the elevator system is optimized, which improves space utilization in the elevator system.

DETAILED DESCRIPTION OF THE EMBODIMENT(S) OF THE INVENTION

Hereinafter, the present application will be described in detail with reference to exemplary embodiments in the accompanying drawings. However, it should be understood that the present application can be implemented in many different forms, and should not be construed as being limited to the embodiments set forth herein. These embodiments are provided herein to make the disclosure of the present application more complete and thorough, and to fully convey the concept of the present application to those skilled in the art.

In addition, for any single technical feature described or implied in the embodiments mentioned herein, or any single technical feature shown or implied in individual drawings, the present application still allows these technical features (or equivalents thereof) to be further arbitrarily combined or deleted without any technical obstacle, thereby obtaining more other embodiments of the present application that may not have been directly mentioned herein.

In order to facilitate the description of the embodiments mentioned herein, a length direction, a width direction and a height direction are introduced as a reference coordinate system. The description as to directions is intended to express relative position relationships between various parts, rather than restrictively restraining their absolute position relationships. Taking an elevator door interlock assembly installed in an elevator system as an example, the height direction refers to a vertical direction in this case, and the length and width directions refer to length and width extension directions of a first lock arm of the elevator door interlock assembly. The length direction generally refers to a direction in which the first lock arm has a longer size in the plane, and the width direction generally refers to a direction in which the first lock arm has a shorter size in the plane.

Furthermore, the characteristic term "elevator door" mentioned herein includes the characteristic term "car door" and the characteristic term "floor door". In the embodiment of the elevator door interlock assembly, the expression "elevator door" is used only for the purpose of brevity; whereas in the embodiment of the elevator system, the expressions "car door" and "floor door" are intended to be describe the connection relationships or action relationships between these features and other surrounding parts more clearly.

Figure 1:
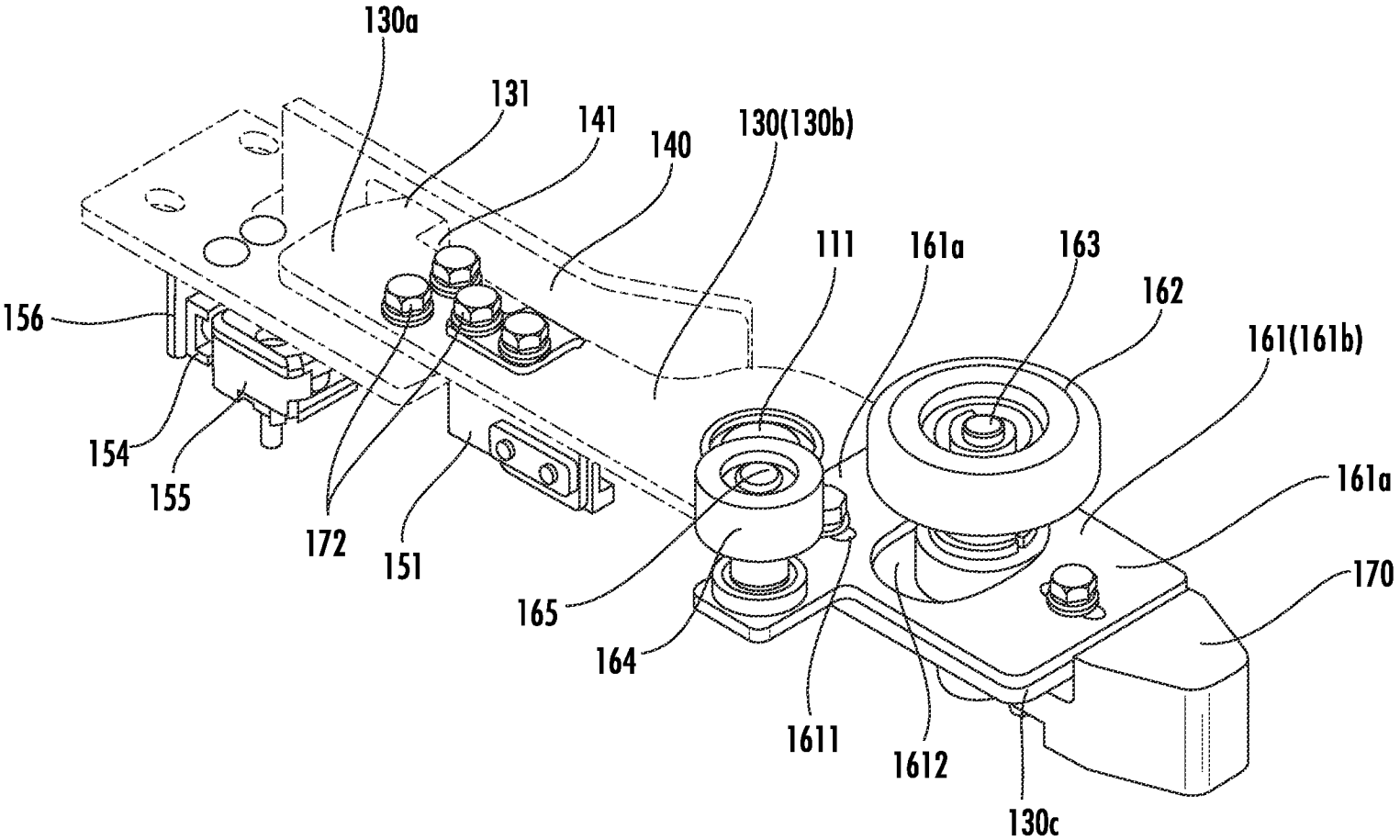
FIG. 1 is a three-dimensional schematic view of an embodiment of an elevator door interlock assembly, in which a first lock arm and a second lock arm are shown in dashed lines, and various parts installed thereon are shown in solid lines.
Figure 2:
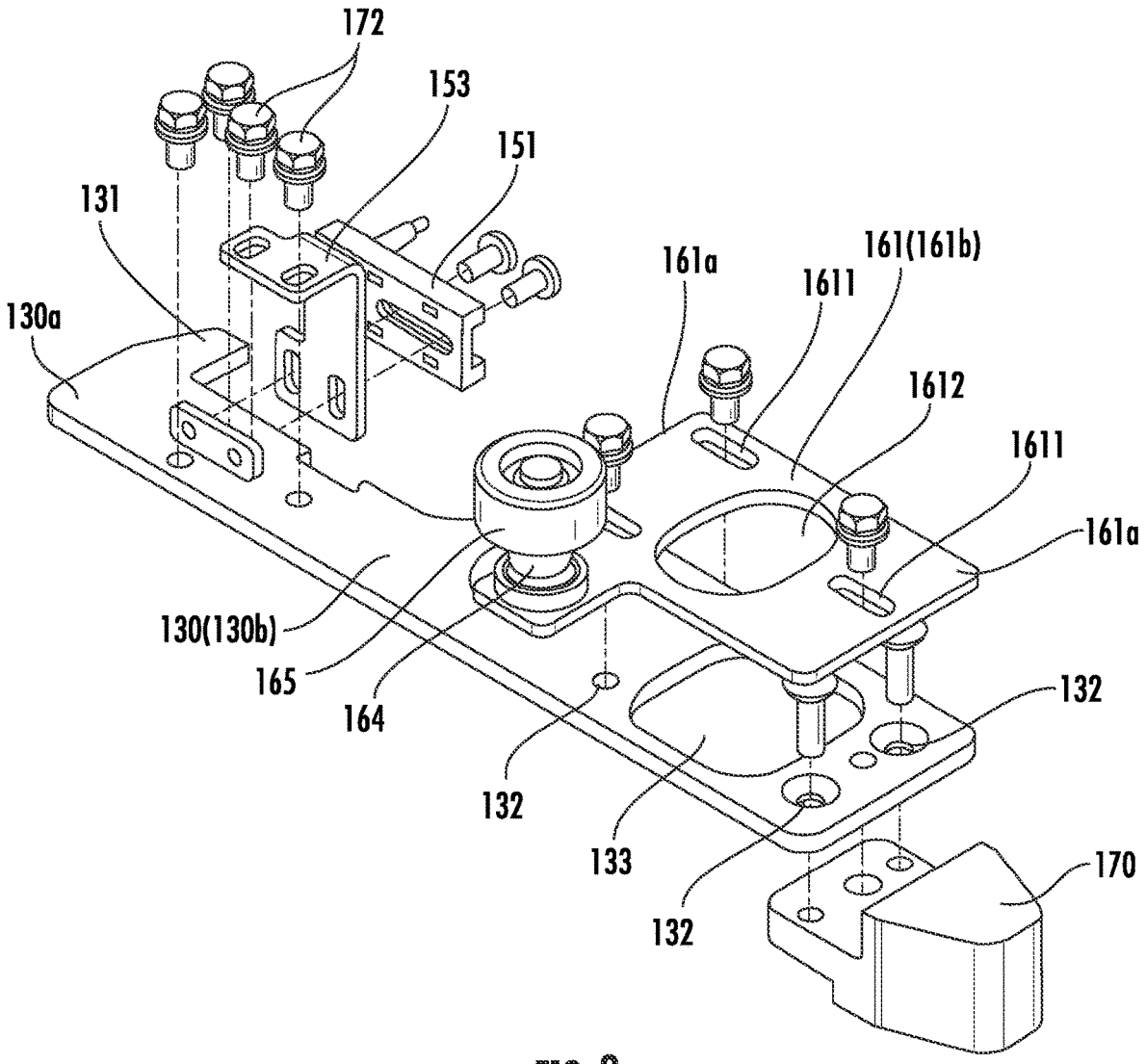
FIG. 2 is a three-dimensional schematic view of an embodiment of the elevator door interlock assembly, in which the first lock arm and related parts are shown.
Figure 3:
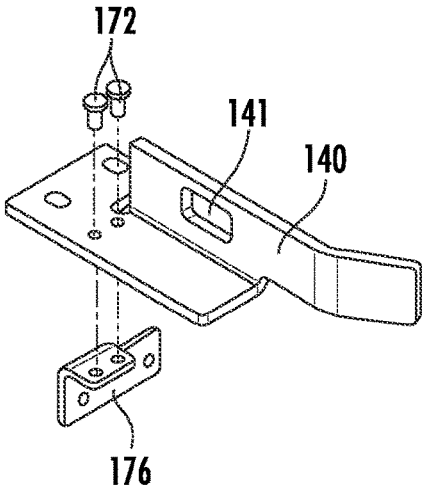
FIG. 3 is a three-dimensional schematic view of an embodiment of the elevator door interlock assembly, in which the second lock arm and related parts are shown.
Figure 4:
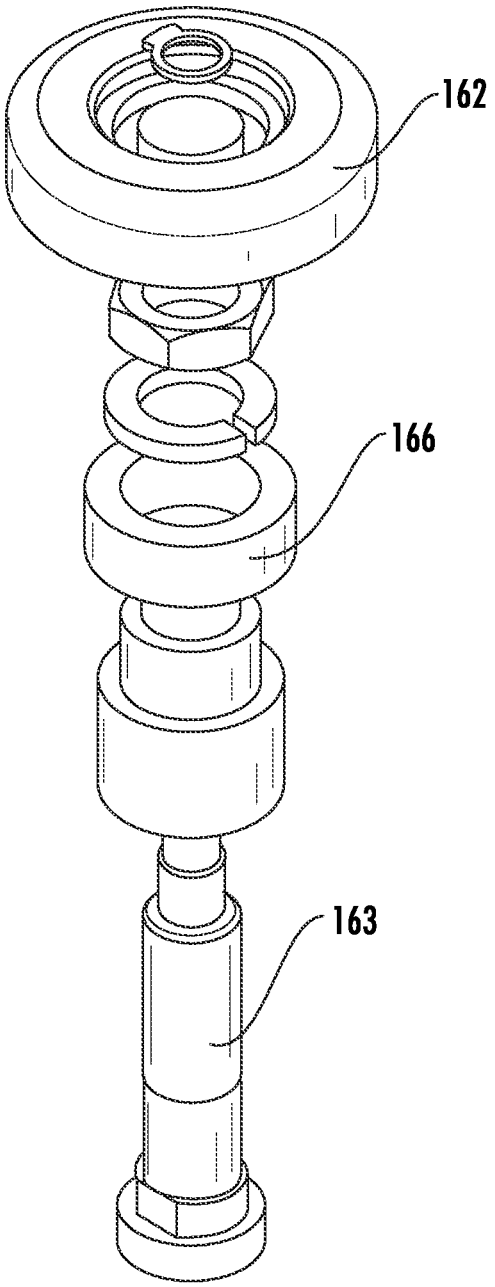
FIG. 4 is a three-dimensional schematic view of an embodiment of the elevator door interlock assembly, in which a first door roller and related parts are shown.
Figure 5:
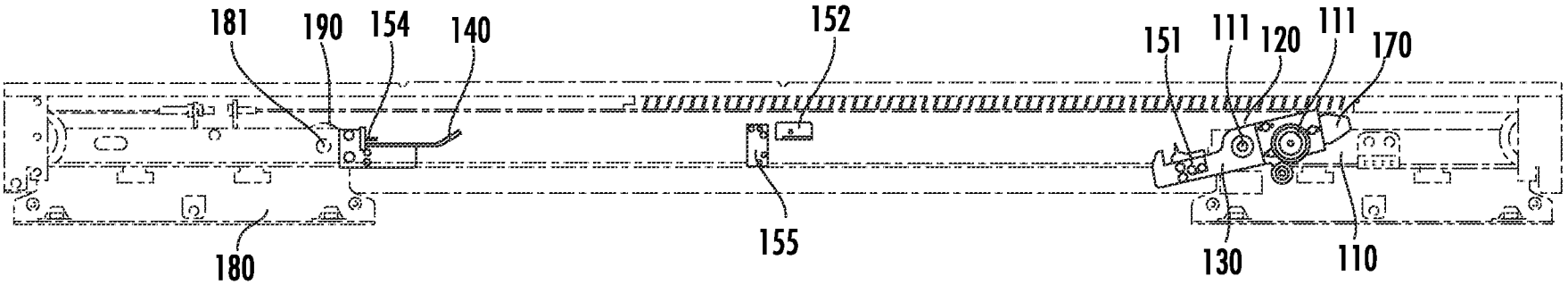
FIG. 5 is a schematic front view of an embodiment of an elevator system in which an elevator door interlock assembly is installed.
Figure 6:
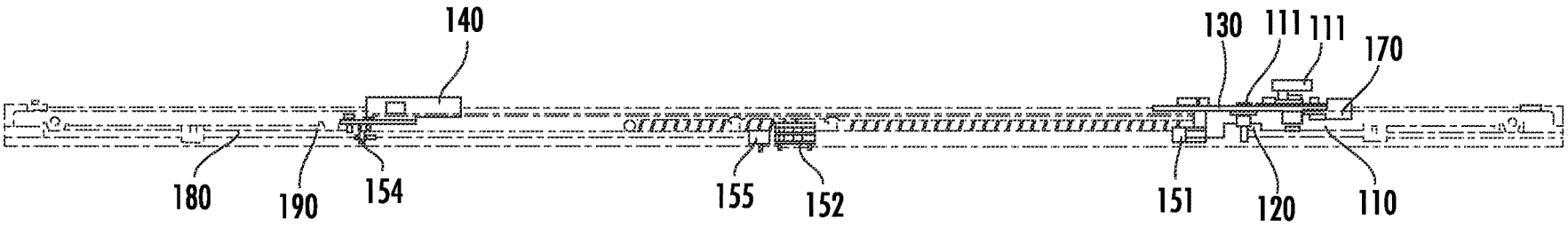
FIG. 6 is a schematic top view of an embodiment of the elevator system in which the elevator door interlock assembly is installed.

In the present application, the elevator door interlock assembly and its arrangement associated with the elevator system will be exemplarily described with reference to FIGS. 1-6. FIGS. 1 to 4 show various parts of the elevator door interlock assembly and their assembly relationships, and FIGS. 5 to 6 show an installation state of the elevator door interlock assembly in the elevator system. The description will be expanded as follows.

Referring to FIGS. 1 to 4, the elevator door interlock assembly generally includes a first lock arm, a second lock arm, and parts associated with these lock arms. First, the present application aims to make a structural improvement on the first lock arm side of the elevator door interlock assembly, so as to optimize its arrangement space.

Specifically, as shown in FIGS. 1 to 6, this type of elevator door interlock assembly includes a first base plate 110, a first hanging wheel 120 and a first lock arm 130. A common rotating shaft 111 is provided on the first base plate 110. The first hanging wheel 120 can be pivotally connected to the first base plate 110 through the common rotating shaft 111. Moreover, due to its own rolling form, the first hanging wheel 120 can guide the first base plate 110 to reciprocate in an opening and closing direction of the elevator door along a track provided in an elevator car or a hoistway of the elevator system, so that: when the elevator door is closed, the first base plate 110 is guided to a middle part of the elevator door, thus enabling other components installed on the first base plate 110 to correspondingly mesh or engage with other oppositely arranged components on the second lock arm side; and when the elevator door is opened, the first base plate 110 can also be guided to a distal side of the elevator door, thereby avoiding mis-meshing or mis-engagement with other components. In addition, a middle part 130*b* of the first lock arm 130 is also pivotally connected to the first base plate 110 through the common rotating shaft 111 so as to rotate between a locked position when the elevator door is closed and a released position. For example, when the elevator door is closed, the first base plate and the first lock arm on it have already been guided to the middle part of the elevator door by the first hanging wheel. At this time, a rotational action of the first lock arm 130 can achieve its engagement with the second lock arm and lock the closed state of the elevator door, and can also realize its disengagement with the second lock arm and release the closed state of the elevator door.

Under any of the above arrangements, in the elevator door interlock assembly according to an embodiment of the present application, by providing the first hanging wheel and the first lock arm with a common rotating shaft for pivotal connection, a coaxial design of the first hanging wheel and the first lock arm is realized without affecting their respective guiding function and locking function. On one hand, an installation bracket dedicated to the first hanging wheel is saved and the cost is reduced; on the other hand, the space which is already extremely compact in the elevator system is optimized, which improves space utilization in the elevator system.

The structural and connection relationships of various parts of the elevator door interlock assembly will be described below in conjunction with FIGS. 1 to 6. In addition, in order to further improve the reliability, practicability, economy or in consideration of other improvements, some additional parts may be added, which are also exemplified as follows.

For example, there are also provided second lock arm side components of the elevator door interlock assembly 100 that cooperate with the first lock arm side components described herein. Specifically, referring to FIGS. 1 to 6, the second lock arm side components may include a second base plate 180, a second hanging wheel 190 and a second lock arm 140. A hanging wheel shaft 181 is provided on the second base plate 180. The second hanging wheel 190 can be pivotally connected to the second base plate 110 through the hanging wheel shaft 181. Moreover, also due to its own rolling form, the second hanging wheel 190 can guide the second base plate 180 to reciprocate in the opening and closing direction of the elevator door along the track provided in the elevator car or the hoistway of the elevator system, so that: when the elevator door is closed, the second base plate 180 is guided to the middle part of the elevator door, thus enabling other components installed on the second base plate 180 to correspondingly mesh or engage with other oppositely arranged components on the first lock arm side; and when the elevator door is opened, the second base plate 180 can also be guided to the distal side of the elevator door, thereby avoiding mis-meshing or mis-engagement with other components. In addition, the second lock arm 140 is fixedly connected to the base plate, so as to realize the cooperation with the first lock arm in a timely manner.

As one of the specific ways of cooperation between the first lock arm 130 and the second lock arm 140, a lock hook 131 may be provided at a first end 130*a* of the first lock arm 130, and a locking opening 141 may be provided on the second lock arm 140. Under this arrangement, when the elevator door is closed, the first base plate 110 and the second base plate 180 respectively guide the first lock arm 130 and the second lock arm 140 to the middle part of the elevator door; then the first lock arm 130 rotates until the lock hook 131 thereof is engaged with the locking opening 141 of the second lock arm 140, and an engagement position of the lock hook 131 with the locking opening 141 is collinear with a rotation center of the common rotating shaft 111. Under the collinear position design, the lock hook 131 and the locking opening 141 have a better meshing stability, and they are not susceptible to the impact of a swinging moment to cause an unhooking problem.

In addition, in order that the elevator door interlock assembly 100 indicates the open and closed state of the elevator door, a safety switch, such as a safety switch in the form of a contact switch, may also be configured for the elevator door interlock assembly 100.

Specifically, the elevator door interlock assembly 100 may include a safety switch arranged on the first lock arm side. The safety switch has a first switch plug 151 arranged on the first lock arm 130 through a first switch installation bracket 153 and fixing members 172, and a first switch socket 152 arranged on a door frame of the elevator door of the elevator system. When the elevator door is closed, the first lock arm 130 rotates until the first switch plug 151 is engaged with the first switch socket 152; moreover, the engagement position of the first switch plug 151 and the first switch socket 152, and the meshing position of the lock hook 131 and the locking opening 141 are collinear with the rotation center of the common rotating shaft 111. The collinear position design of the three provides a better meshing stability for the lock hook 131 and the lock opening 141, so that they are not susceptible to the impact of a swinging moment to cause an unhooking problem; and at the same time, the collinear position design also provides a better engagement stability for the first switch plug 151 and the first switch socket 152 of the safety switch, so that they are not susceptible to the impact of the swing moment to cause an open circuit problem.

Similarly, the elevator door interlock assembly 100 also includes a second switch plug 154 arranged on the second lock arm 140 through a second switch installation bracket 156 and fixing members 172, and a second switch socket 155 arranged on the door frame of the elevator door of the elevator system. When the elevator door is closed, the first base plate 110 moves in the opening and closing direction of the elevator door until the second switch plug 154 on the second lock arm 140 is engaged with the second switch socket 155. The design of dual safety switches provides double assurance for indicating the open and closed state of the elevator door.

For another example, in order to realize an associated movement of a landing door and a car door in the elevator door, an arrangement of a door blade and door rollers that cooperate with each other may be provided for the landing door and the car door. In this case, the elevator door interlock assembly 100 also has a corresponding connecting component to realize an adjustable installation of the door rollers, so as to adapt to the dimensional error or change of the elevator application scene, etc. Specifically, the elevator door interlock assembly 100 further includes an adjustable connecting plate 161, a first door roller 162 and a second door roller 164. The adjustable connecting plate 161 has an installation position fixed to a second end 130*c* of the first lock arm 130, and the installation position can be adjusted in the length direction of the first lock arm 130, so as to further realize position adjustment of the door rollers installed thereon. Specifically, the first door roller 162 passes through a middle part 161*b* of the adjustable connecting plate 161 via a first rotating shaft 163 and is pivotally connected to the first base plate 110, and the second door roller 164 is pivotally connected to a lower part of the adjustable connecting plate 161 via a second rotating shaft 165.

On this basis, as a further improvement to the position adjustment scheme of the door roller, the following detailed designs may also be made to the above structure. For example, an end 161*a* of the adjustable connecting plate 161 is provided with first strip holes 1611 arranged in the length direction thereof, and the second end 130*c* of the first lock arm 130 is provided with fixing holes 132. In this case, the adjustment of the installation position of the adjustable connecting plate 161 is realized through the cooperation of the fixing holes 132 and the first strip holes 1611. As an example, when the first door roller and the second door roller need to be moved laterally, the fixing holes 132 can be aligned with different positions of the first strip holes 1611 to realize the relative displacement of the adjustable connecting plate 161 and the first lock arm 130. After a proper position adjustment is achieved, the fixing members 172 are used to fasten them. Of course, the positions of the above fixing holes and the first strip holes may also be reversed to each other, which can also achieve a similar adjustment purpose.

Further, a second strip hole 1612 arranged perpendicular to the first strip holes 1611 may be provided in the middle part 161*b* of the adjustable connecting plate 161, and an adjustment hole 133 may be provided in the second end 130*c* of the first lock arm 130. In this case, the adjustment of the installation position of the adjustable connecting plate 161 may also be achieved through the cooperation of the adjustment hole 133 and the second strip hole 1612. As an example, when the first door roller and the second door roller need to be moved laterally, the second strip hole 1612 can be aligned with different positions of the adjustment hole 133 together with the above fixing holes 132 aligned with the first strip holes 1611 to realize the relative displacement of the adjustable connecting plate 161 and the first lock arm 130. After a proper position adjustment is achieved, the fixing holes 132 and the first strip holes 1611 are fastened by the fixing members 172 to realize integrally fixing the adjustable connecting plate 161 and the first lock arm 130. In addition, when the relative position of the first door roller and the second door roller needs to be adjusted, a bushing 166 sleeved over the rotating shaft 163 which passes through the second strip hole 1612 of the adjustable connecting plate 161 and the adjustment hole 133 of the first lock arm 130 at the same time can be used to adjust the installation position of the first door roller 162 in the length direction of the second strip hole 1612, and the first rotating shaft 163 can be tightened again after the adjustment is completed.

On the other hand, considering the relative stability of the matching position of the second door roller 164 with the track on the base plate, it is also possible not to separately provide an adjustment function for itself. In this case, the second rotating shaft 165 is arranged at a fixed position of the lower part of the adjustable connecting plate 161, and the second door roller 164 is fixedly pivoted to the lower part of the adjustable connecting plate 161 via the second rotating shaft 165.

Optionally, as a detailed design of the coaxial scheme in the foregoing embodiment, the first hanging wheel 120 may be arranged between the first base plate 110 and the first lock arm 130 to avoid interference of movements of these components when they are performing their respective functions.

Optionally, in order to promote the stability of the rotation process and the meshing state of the first lock arm, the elevator door interlock assembly 100 may further include a counterweight 171, which is arranged at the second end 130*c* of the first lock arm 130. In this case, the counterweight 171 presses the lock hook 131 to abut against the lock opening 141 relative to the rotating shaft.

It should also be known that the elevator door interlock assembly provided by the present application and other parts of the elevator system can be designed, manufactured, and sold separately, or they can also be assembled together and then sold as a whole. Either the single pieces formed before the combination or the entirety formed after the combination will fall within the scope of protection of the present application.

In addition, although not shown wholly in the drawings, an embodiment of an elevator system is also provided herein in conjunction with FIG. 5 and FIG. 6. The elevator system includes the elevator door interlock assembly in any of the foregoing embodiments or combinations thereof, so it also has various effects brought about by the elevator door interlock assembly, which will not be repeated herein. The following will focus on the arrangement position of the elevator door interlock assembly in the elevator system and its additional technical effects when applied to the elevator system.

The elevator system includes an elevator car with a car door and a landing door arranged in the lobby of each floor of the building. A top of the landing door is provided with a landing door lintel. The landing door lintel cooperates with the door blade and the door rollers to realize the associated movement of the landing door and the car door; that is, the opening and closing of the car door will drive the landing door to open and close at the same time. In addition, the elevator system also has an elevator door interlock assembly 100. When the landing door and the car door moving in association are closed, the first lock arm 130 rotates between the locked position and the released position, so as to maintain the closed state of the landing door and the car door, or release the closed state of the landing door and the car door. Furthermore, the first switch socket 152 and the second switch socket 155 in the elevator door interlock assembly 100 are both arranged on the landing door so as to be engaged with the first switch plug 151 and the second switch plug 154 respectively. The first switch socket 152 is installed on the landing door in a way of facing the landing door, thereby avoiding dust intrusion in the application scene.

In the above examples, the elevator door interlock assembly and the elevator system of the present application are mainly described. Although only some of the embodiments of the present application have been described, those skilled in the art should understand that the present application may be implemented in many other forms without departing from the spirit and scope thereof. Therefore, the illustrated examples and embodiments should be regarded as illustrative rather than restrictive, and the present application may cover various modifications and replacements without departing from the spirit and scope of the present application as defined by the appended claims.

What is claimed is:

1. An elevator door interlock assembly, comprising:

a first base plate on which a common rotating shaft is arranged;

a first hanging wheel, which is pivotally connected to the first base plate through the common rotating shaft and guides the first base plate to reciprocate in an opening and closing direction of an elevator door;

a first lock arm, a middle part of which is pivotally connected to the first base plate through the common rotating shaft, so as to rotate between a locked position and a released position when the elevator door is closed;

a second base plate on which a hanging wheel shaft is arranged;

a second hanging wheel, which is pivotally connected to the second base plate through the hanging wheel shaft, and guides the second base plate to reciprocate in the opening and closing direction of the elevator door; and a second lock arm, which is fixedly connected to the base plate and which is provided with a locking opening thereon;

wherein a lock hook is also provided at a first end of the first lock arm; when the elevator door is closed, the first lock arm rotates until the lock hook and the locking opening are meshed, and a meshing position of the lock hook and the locking opening is collinear with a rotation center of the common rotating shaft.

2. The elevator door interlock assembly according to claim 1, further comprising:

a first switch plug, which is provided on the first lock arm; and a first switch socket;

wherein when the elevator door is closed, the first lock arm rotates until the first switch plug is engaged with the first switch socket; an engagement position of the first switch plug and the first switch socket, and the meshing position of the lock hook and the locking opening are collinear with the rotation center of the common rotating shaft.

3. The elevator door interlock assembly according to claim 1, further comprising:

a second switch plug, which is provided on the second lock arm; and a second switch socket;

wherein when the elevator door is closed, the first base plate moves in the opening and closing direction of the elevator door until the second switch plug on the second lock arm is engaged with the second switch socket.

4. The elevator door interlock assembly according to claim 1, further comprising:

an adjustable connecting plate, which has an installation position fixed to a second end of the first lock arm, the installation position being adjustable in a length direction of the first lock arm;

a first door roller, which passes through a middle part of the adjustable connecting plate via a first rotating shaft and is pivotally connected to the first base plate; and a second door roller, which is pivotally connected to a lower part of the adjustable connecting plate via a second rotating shaft.

5. The elevator door interlock assembly according to claim 4, wherein one of an end of the adjustable connecting plate and/or the second end of the first lock arm has fixing holes, and the other of the end of the adjustable connecting plate and/or the second end of the first lock arm has first strip holes arranged in a length direction; wherein the adjustment of the installation position of the adjustable connecting plate is realized through the cooperation of the fixing holes and the first strip holes.

6. The elevator door interlock assembly according to claim 5, wherein the middle part of the adjustable connecting plate has a second strip hole arranged perpendicular to the first strip holes, and the second end of the first lock arm has an adjustment hole; wherein the adjustment of the installation position of the adjustable connecting plate is also realized through the cooperation of the adjustment hole and the second strip hole.

7. The elevator door interlock assembly according to claim 6, wherein the first rotating shaft passes through the second strip hole of the adjustable connecting plate, and an installation position of the first door roller can be adjusted along a length direction of the second strip hole.

8. The elevator door interlock assembly according to claim 5, further comprising:

a second rotating shaft arranged at a fixed position at the lower part of the adjustable connecting plate, and the second door roller is pivotally connected to the lower part of the adjustable connecting plate via the second rotating shaft.

9. The elevator door interlock assembly according to claim 1, wherein the first hanging wheel is arranged between the first base plate and the first lock arm.

10. The elevator door interlock assembly according to claim 1, further comprising a counterweight, which is arranged at a second end of the first lock arm; wherein the counterweight presses the lock hook to abut against the locking opening relative to the rotating shaft.

11. An elevator system, comprising:

an elevator car having a car door;

a landing door moving in association with the car door; and the elevator door interlock assembly according to claim 1;

wherein when the landing door and the car door moving in association are closed, the first lock arm rotates between the locked position and the released position to maintain the closed state of the landing door and the car door, or release the closed state of the landing door and the car door.

12. The elevator system according to claim 11, wherein when the elevator door interlock assembly comprises a first switch plug and a first switch socket, the first switch socket is arranged on the landing door and is engaged with the first switch plug in a way of facing downward.

* * * * *